US012325929B2

(12) United States Patent
Liao et al.

(10) Patent No.: US 12,325,929 B2
(45) Date of Patent: Jun. 10, 2025

(54) METHOD FOR SMOOTHING SURFACE OF COPPER FOIL AND COPPER FOIL OBTAINED

(71) Applicant: NAN YA PLASTICS CORPORATION, Taipei (TW)

(72) Inventors: Te-Chao Liao, Taipei (TW); Wei-Sheng Cheng, Taipei (TW); Chao-Tung Wu, Taipei (TW)

(73) Assignee: NAN YA PLASTICS CORPORATION, Taipei (TW)

( * ) Notice: Subject to any disclaimer, the term of this patent is extended or adjusted under 35 U.S.C. 154(b) by 0 days.

(21) Appl. No.: 18/182,365

(22) Filed: Mar. 13, 2023

(65) Prior Publication Data

US 2024/0218554 A1 Jul. 4, 2024

(30) Foreign Application Priority Data

Dec. 30, 2022 (TW) ..... 111150781

(51) Int. Cl.
*C25F 3/22* (2006.01)
*C23G 1/10* (2006.01)

(52) U.S. Cl.
CPC ..... *C25F 3/22* (2013.01); *C23G 1/103* (2013.01)

(58) Field of Classification Search
CPC ..... C25F 3/22; C23G 1/103; C23F 1/18
See application file for complete search history.

(56) References Cited

U.S. PATENT DOCUMENTS

| | | | | |
|---|---|---|---|---|
| 7,112,271 | B2 | 9/2006 | Jo et al. | |
| 2003/0155255 | A1* | 8/2003 | Yahalom | C25F 3/22 205/640 |
| 2008/0067077 | A1* | 3/2008 | Kodera | B23H 5/08 205/684 |

FOREIGN PATENT DOCUMENTS

| | | | | |
|---|---|---|---|---|
| CN | 110699749 | | 11/2020 | |
| CN | 112921389 | | 6/2021 | |
| CN | 115386926 | | 11/2022 | |
| EP | 1167585 | A2 * | 1/2002 | C25F 3/02 |
| TW | 201343029 | | 10/2013 | |

OTHER PUBLICATIONS

"Office Action of Taiwan Counterpart Application", issued on Oct. 11, 2023, p. 1-p. 8.
"Office Action of Taiwan Counterpart Application", issued on Mar. 21, 2025, p. 1-p. 7.

* cited by examiner

*Primary Examiner* — Brian W Cohen
(74) *Attorney, Agent, or Firm* — JCIPRNET

(57) ABSTRACT

A method for smoothing surfaces of a copper foil and the copper foil obtained are provided, wherein the method for smoothing surfaces of the copper foil includes the following steps. Supplied with a copper foil. A first electropolishing process is performed on the copper foil. The copper foil is subjected to a pickling process. A second electropolishing process is performed on the copper foil.

9 Claims, 1 Drawing Sheet

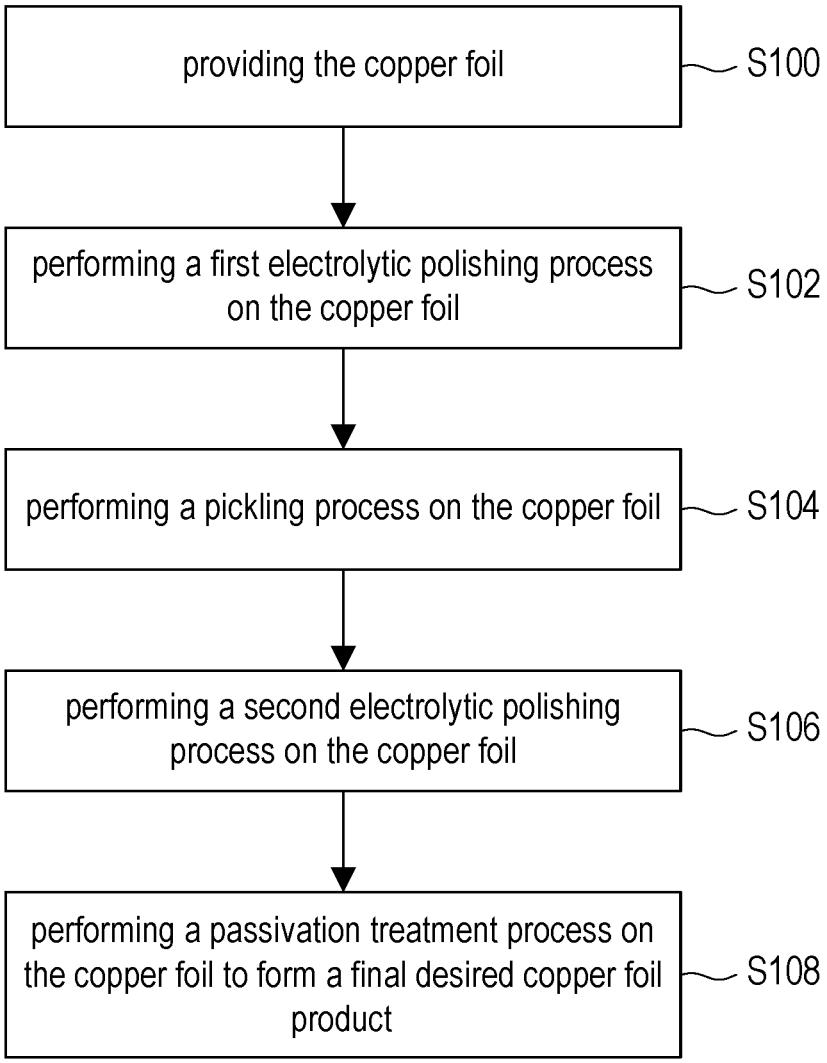
providing the copper foil
S100
performing a first electrolytic polishing process on the copper foil
S102
performing a pickling process on the copper foil
S104
performing a second electrolytic polishing process on the copper foil
S106
performing a passivation treatment process on the copper foil to form a final desired copper foil product
S108

METHOD FOR SMOOTHING SURFACE OF COPPER FOIL AND COPPER FOIL OBTAINED

CROSS-REFERENCE TO RELATED APPLICATION

This application claims the priority benefit of Taiwan application serial no. 111150781, filed on Dec. 30, 2022. The entirety of the above-mentioned patent application is hereby incorporated by reference herein and made a part of this specification.

BACKGROUND

Technical Field

The disclosure relates to a method for the surface treatment of copper foil, and more particularly, to a method for smoothing the surface of copper foil.

Description of Related Art

The low signal loss of copper foil is the key to maintaining signal integrity. When the signal becomes high-frequency and high-speed, the signal transmission is more and more concentrated on the surface of the copper foil, so the shape of the surface of the copper foil is related to the integrity of the signal transmission. When the surface roughness of the copper foil is higher (that is, the smoothness is lower), the standing wave and reflection of the transmitted signal will become more serious, resulting in a longer signal transmission path and increased signal loss.

In order to reduce the surface roughness of the copper foil, the prior art is polishing the surface of the copper foil, such as mechanical polishing (such as grinding) or electrolytic polishing, wherein the electrolytic polishing has limitations on reducing the surface roughness of the copper foil. Specifically, during the process of electrolytic polishing, when the accumulated charge on the surface of the copper foil is higher than a certain amount, over-polishing or pitting will occur at this time, so that the surface roughness of the copper foil will increase instead. Therefore, developing a new method for smoothing the surface of copper foil is the current goal of the industry.

SUMMARY

The present disclosure provides a method for smoothing a surface of a copper foil, which can effectively reduce the surface roughness of copper foil and reduce the occurrence of pitting.

A method for smoothing a surface of a copper foil in the present disclosure includes the following steps: providing the copper foil; performing a first electrolytic polishing process on the copper foil; performing a pickling process on the copper foil; and performing a second electrolytic polishing process on the copper foil.

In an embodiment of the present disclosure, the pickling process is performed after the first electrolytic polishing process and before the second electrolytic polishing process, and the pickling process includes the following step: cleaning the copper foil with a pickling solution having a pH value of −1 to 2.

In an embodiment of the present disclosure, the pickling solution includes phosphoric acid or sulfuric acid, and a content of the phosphoric acid or the sulfuric acid ranges from 2 wt % to 20 wt % based on a total weight of the pickling solution.

In an embodiment of the present disclosure, the first electrolytic polishing process includes the following step: placing the copper foil in a polishing solution for electrolytic polishing, wherein the polishing solution includes at least one nitrogen-containing organic additive, and a content of the at least one nitrogen-containing organic additive ranges from 0.0001 wt % to 1 wt % based on a total weight of the polishing solution.

In an embodiment of the present disclosure, the at least one nitrogen-containing organic additive includes urea, 2-mercaptobenzoxazole, benzotriazole, 4-carboxybenzotriazole, 5-aminotetrazole, triazol-3-amine or combinations thereof.

In an embodiment of the present disclosure, the first electrolytic polishing process includes the following conditions: a current density is 5 $A/dm^2$ to 100 $A/dm^2$ and a polishing time is 5 s to 40 s.

In an embodiment of the present disclosure, the second electrolytic polishing process includes the following conditions: a current density is 5 $A/dm^2$ to 80 $A/dm^2$ and a polishing time is 5 s to 40 s.

In an embodiment of the present disclosure, the method further including: performing a passivation treatment process on the copper foil after performing the second electrolytic polishing process.

In an embodiment of the present disclosure, a polishing time of the second electrolytic polishing process is less than a polishing time of the first electrolytic polishing process, and a current density of the second electrolytic polishing process is lower than a current density of the first electrolytic polishing process.

A finished copper foil is obtained by any one of the above methods, wherein an average roughness of a surface of the finished copper foil is equal to or less than 1 micrometer.

To sum up, in the present disclosure, by adding a pickling process between a first electrolytic polishing process and a second electrolytic polishing process, it can remove copper oxide formed on copper foil and/or copper phosphate partially deposited on copper foil during the first electrolytic polishing process. In this way, an average roughness of the surface of the copper foil can be effectively reduced and occurrence of pitting corrosion can be reduced even when the surface of the copper foil has accumulated a high amount of charge due to electrolytic polishing.

BRIEF DESCRIPTION OF THE DRAWINGS

FIGURE is a schematic flowchart of a method for smoothing a surface of a copper foil according to an embodiment of the present disclosure.

DESCRIPTION OF THE EMBODIMENTS

Embodiments of the disclosure will be described in details below. However, these embodiments are illustrative, and the disclosure is not limited thereto.

Herein, a range indicated by "one value to another value" is a general representation which avoids enumerating all values in the range in the specification. Therefore, the description of a specific numerical range covers any numerical value within the numerical range and the smaller numerical range bounded by any numerical value within the numerical range, as if the arbitrary numerical value and the smaller numerical range are written in the specification.

FIGURE is a schematic flowchart of a method for smoothing a surface of a copper foil according to an embodiment of the present disclosure. Referring to FIGURE, step S100 is executed: providing a copper foil. The copper foil can be, for example, disc-shaped, block-shaped, sheet-shaped or other irregular shapes, but is not limited thereto.

Next, step S102 is executed: performing a first electrolytic polishing process on the copper foil. That is, the copper foil is placed in a polishing solution for the first electrolytic polishing. In some embodiments, the conditions of the first electrolytic polishing process may be, for example, a current density of 5 $A/dm^2$ to 100 $A/dm^2$, and a polishing time of 5 seconds (s) to 40 seconds. In other embodiments, the current density may be about 30 $A/dm^2$ to 50 $A/dm^2$, and the polishing time may be about 10 s to 20 s. When the current density is less than 5 $A/dm^2$ and the polishing time is less than 5 seconds, there is almost no polishing effect (i.e., the roughness of the copper foil surface cannot be reduced). When the current density is greater than 100 $A/dm^2$ and the polishing time is greater than 40 seconds, severe over-polishing and a large number of pitting may occur, resulting in a substantial increase in the average roughness of the surface of the copper foil, even higher than the average roughness of the copper foil surface that has not been electropolished. Furthermore, when the current density is 30 $A/dm^2$ to 50 $A/dm^2$, and the polishing time is 10 seconds to 20 seconds, over-polishing and pitting can be effectively avoided. It should be noting that, in some embodiments, when the polishing time exceed 20 seconds (for example, 30 seconds), the average roughness of the surface of the copper foil can be greater than that of copper foil polished with polishing seconds between 10 seconds and 20 seconds. The above results may indicate that polishing after 20 seconds may cause pitting. Here, it is speculated that when polishing exceeds 20 seconds, some copper may be oxidized or copper phosphate may be deposited on the surface of the copper foil. Since a part of the copper surface covered by the impure copper material will not be polished, other parts of the exposed copper surface may continue to be electrolyzed, resulting in pitting corrosion.

In an embodiment of the present disclosure, the polishing solution may optionally include at least one nitrogen-containing organic additive. Nitrogen-containing organic additives will form metal complexes with surface copper and can be used to reduce the occurrence of over-polishing. In some embodiments, the at least one nitrogen-containing organic additive may include, for example, urea, 2-Mercaptobenzoxazole (MBO), Benzotriazole, 4-Carboxybenzotriazole, 5-Aminotetrazole and Triazol-3-amine or combinations thereof, but is not limited thereto. In some embodiments, based on a total weight of the polishing solution, a content of the at least one nitrogen-containing organic additive ranges from 0.0001 wt % to 1 wt %; preferably, a content of the at least one nitrogen-containing organic additive ranges 0.0001 wt % to 0.5% wt %. When the content of the nitrogen-containing organic additive is less than 0.0001 wt %, it may have no effect because the concentration is too low. When the content of the nitrogen-containing organic additive is greater than 1 wt %, the polishing rate may be reduced and it is not conducive to improving the surface roughness.

Next, please refer to FIGURE again, step S104 is executed: performing a pickling process on the copper foil. Specifically, after the first electrolytic polishing process, the copper foil is firstly taken out, washed with water to remove the polishing solution, and then the copper foil is placed in a pickling solution for the pickling process. In this embodiment, the pickling process is performed after the first electrolytic polishing process and before performing the subsequent second electrolytic polishing process. In some embodiments, the pickling process includes the following step: cleaning the copper foil with a pickling solution having a pH value of −1 to 2. In other words, the pickling process uses a pickling solution to clean the copper foil after the first electrolytic polishing process.

In some embodiments, the pickling solution may include phosphoric acid or sulfuric acid, but is not limited thereto. In some embodiments of the present disclosure, based on a total weight of the pickling solution, a content of phosphoric acid or sulfuric acid ranges from 2 wt % to 20 wt %; preferably, a content of phosphoric acid or sulfuric acid ranges from 5 wt % to 15 wt %. When the content of phosphoric acid or sulfuric acid is less than 2 wt %, the pickling process may not have the effect of smoothing the surface of the copper foil (that is, adding the steps of the pickling process may not be beneficial to the reduction of the surface roughness). In this step S104, the copper oxide on the surface of the copper foil can be removed (dissolved) by acid, thereby reducing the roughness of the surface of the copper foil.

Next, step S106 is executed: performing a second electrolytic polishing process on the copper foil. Specifically, after the pickling process and water washing to remove the pickling solution, the copper foil is then placed in a polishing solution, and the copper foil is subjected to the second electrolytic polishing. The conditions of the second electrolytic polishing process may be the same as or different from the conditions of the first electrolytic polishing process. In some embodiments, when the polishing time and current density of the second electrolytic polishing process are both less than the polishing time and current density of the first electrolytic polishing process, better polishing effect can be obtained. In some embodiments, the current density of the second electrolytic polishing process may be about 5 $A/dm^2$ to 80 $A/dm^2$, and the polishing time may be about 5 seconds to 40 seconds. When the current density is less than 5 $A/dm^2$ and the polishing time is less than 5 seconds, there is almost no polishing effect (i.e., the roughness of the copper foil surface cannot be reduced). When the current density is greater than 80 $A/dm^2$ and the polishing time is greater than 40 seconds, severe over-polishing and a large amount of pitting may occur.

In addition, the composition and proportion of the polishing solution used in the second electrolytic polishing process may be the same as or different from the composition and proportion of the polishing solution used in the first electrolytic polishing process, and the present disclosure is not limited here.

Next, step S108 is executed: performing a passivation treatment process on the copper foil to form a final desired copper foil product. Specifically, after the second electrolytic polishing process, the copper foil is firstly taken out, washed with water to remove the polishing solution, and then the copper foil is subjected to passivation treatment process, and then the copper foil is washed with water to obtain the desired copper foil product. So far, the method for smoothing the surface of the copper foil in the present disclosure has been completed.

In this embodiment, by adding a pickling process between the first electrolytic polishing process and the second electrolytic polishing process, it can effectively reduce the average roughness of copper foil surface under high charge flux, and avoid the occurrence of pitting corrosion. For example, after the above treatment, the average roughness (Rz) of the surface of the copper foil may be equal to or less than 1 micrometer (μm) or between 0.2 μm and 1 μm.

The following embodiments are provided to illustrate the effect of the method for smoothing the surface of copper foil of the present disclosure. However, the following embodiments are not intended to limit the scope of the present disclosure. In particular, the average roughness of the original surface of the copper foil used in the following embodiments is about 1.5 μm to 2.0 μm.

Embodiment 1. Polishing Time Test and Polishing Additive Selection in Electrolytic Polishing Process Sample treatment: putting a copper foil into a pickling solution for a pickling process. Next, after taking out the copper foil and washing it with water, the copper foil was respectively placed in the corresponding polishing solution to carry out the electrolytic polishing process. The current density of the electrolytic polishing process was 50 A/dm$^2$, and the polishing times were shown in Table 1, wherein the polishing times is 20 seconds for Example 1 and the polishing times is 40 seconds for Example 2 to Example 5. Next, the copper foil is taken out, washed with water and subjected to passivation treatment, so as to obtain the finished copper foil product to be tested. In this embodiment, the pickling solution is 10 wt % of sulfuric acid solution. The polishing solution used in Example 1 and Example 2 contains 483 g/L of the phosphoric acid solution and do not contain any polishing additive. The polishing solution used in Example 3 contains 483 g/L of the phosphoric acid solution and 100 mg/L of thiourea as a polishing additive. The polishing solution used in Example 4 contains 483 g/L of the phosphoric acid solution and 100 mg/L of gelatin as a polishing additive. The polishing solution used in Example 5 contains 483 g/L of the phosphoric acid solution and 1 g/L of urea as a polishing additive.

Analysis of the average roughness (Rz): using a KEYENCE model VK-X1000 laser microscope to measure the average roughness (Rz) of the surface of the finished copper foil at a magnification of 1000 times. The obtained value is the average value of three points. The results are shown in Table 1.

TABLE 1

| | Example 1 | Example 2 | Example 3 | Example 4 | Example 5 |
|---|---|---|---|---|---|
| Phosphoric acid (g/L) | 483 | 483 | 483 | 483 | 483 |
| Thiourea (mg/L) | — | — | 100 | — | — |
| Gelatin (mg/L) | — | — | — | 100 | — |
| Urea (g/L) | — | — | — | — | 1 |
| Current density (A/dm$^2$) | 50 | 50 | 50 | 50 | 50 |
| Polishing times (s) | 20 | 40 | 40 | 40 | 40 |
| Rz (μm) | 0.629 | 0.993 | 1.284 | 1.058 | 0.726 |

In this embodiment, the average roughness of the original surface of the copper foil is about 1.5 μm. From Example 1 in Table 1, when the current density is 50 A/dm$^2$ and the polishing time is 20 seconds, it can effectively reduce the average roughness of the surface of the finished copper foil product and increase the smoothness of the surface of the finished copper foil product. However, from Example 2 in Table 1, when the current density is 50 A/dm$^2$ and the polishing time is 40 seconds, the average roughness of the surface of the finished copper foil product is increased compared with Example 1. Observation by a microscope shows that compared with Example 2, the surface of the finished copper foil product of Example 1 is smoother, while the surface of the finished copper foil product of Example 2 has pitting corrosion (data not shown). In addition, as can be seen from Examples 2 to 5 in Table 1, compared with no polishing additive (Example 2), using thiourea (Example 3), gelatin (Example 4) or urea (Example 5) as a polishing additive can effectively reduce the average roughness of the surface and contribute to the polishing effect of the electrolytic polishing process.

Embodiment 2. Two Electrolytic Polishing Process

Sample treatment: the copper foil that has completed the first electrolytic polishing process is directly subjected to the second electrolytic polishing process, and then the copper foil is washed and passivated sequentially to obtain a finished copper foil product to be tested. In this embodiment, the current density of the first electrolytic polishing process is 50 A/dm$^2$, and the polishing time is 20 seconds. The current density of the second electrolytic polishing process is shown in Table 2 below, which are 50 A/dm$^2$ (Example 6), 40 A/dm$^2$ (Example 7) or 30 A/dm$^2$ (Example 8), and the polishing time is 20 seconds.

Analysis of the average roughness (Rz): using a KEYENCE model VK-X1000 laser microscope to measure the average roughness (Rz) of the surface of the finished copper foil at a magnification of 1000 times. The obtained value is the average value of three points. The results are shown in Table 2.

TABLE 2

| | Example 6 | Example 7 | Example 8 |
|---|---|---|---|
| Current density of the first electrolytic polishing process (A/dm$^2$) | 50 | 50 | 50 |
| Current density of the second electrolytic polishing process (A/dm$^2$) | 50 | 40 | 30 |
| Rz (μm) | 1.102 | 1.139 | 1.183 |

In this embodiment, the average roughness of the original surface of the copper foil is about 1.5 μm. From Example 1 of table 1 and Example 6 to example 7 of table 2, it reveals that after the first electropolishing process on the copper foil (Rz of Example 1 is about 0.629 μm), if the second electropolishing process is performed after only washing with water (that is, there is only a water washing step between the two electropolishing processes), it will not reduce the average roughness of the surface of the finished copper foil product, but will increase the average roughness of the surface of the finished copper foil product (Rz of Example 6 is about 1.102 μm; Rz of Example 7 is about 1.139 μm; Rz of Example 8 is about 1.183 μm).

Embodiment 3. Pickling Process is Added Between Two Electrolytic Polishing Processes Sample treatment: after the first electrolytic polishing process, the copper foil is put into a pickling solution for a pickling process. Next, after washing with water, the copper foil is placed in a polishing solution for a second electropolishing process, and then the copper foil is washed with water and passivated sequentially to obtain a finished copper foil product to be tested. In this embodiment, the pickling solution is 10 wt % of sulfuric acid solution. The polishing solution contains 483 g/L of the phosphoric acid solution and 1 g/L of urea as a polishing additive. The current densities of the first electrolytic polishing process and the second electrolytic polishing process are both 50 A/dm$^2$, and the corresponding polishing times are shown in Table 3.

Analysis of the average roughness (Rz): using a KEYENCE model VK-X1000 laser microscope to measure the average roughness (Rz) of the surface of the finished copper foil at a magnification of 1000 times. The obtained value is the average value of three points. The results are shown in Table 3.

TABLE 3

| | Example 9 | Example 10 | Example 11 | Example 12 |
|---|---|---|---|---|
| Phosphoric acid (g/L) | 483 | 483 | 483 | 483 |
| Urea (g/L) | 1 | 1 | 1 | 1 |
| Current density (A/dm$^2$) | 50 | 50 | 50 | 50 |
| Polishing time of the first electrolytic polishing process (s) | 20 | 20 | 20 | 15 |
| Polishing time of the second electrolytic polishing process (s) | 10 | 15 | 20 | 15 |
| Rz (μm) | 0.600 | 0.523 | 0.713 | 0.723 |

In this embodiment, the average roughness of the original surface of the copper foil is about 1.5 μm. It can be seen from Table 3 that the pickling process with 10 wt % sulfuric acid solution as the pickling solution inserted between the first electrolytic polishing process and the second electrolytic polishing process can effectively reduce the average roughness of the surface of the finished copper foil product (Rz of Example 9 is about 0.6 μm; Rz of Example 10 is about 0.523 μm; Rz of Example 11 is about 0.713 μm; Rz of Example 12 is about 0.723 μm). In addition, observed by a microscope, the surfaces of the finished copper foils of Examples 9 to 12 are almost free of pitting corrosion (the average roughness of the surface can be further reduced).

Furthermore, compared with the same conditions of the first electrolytic polishing process and the second electrolytic polishing process (Example 11, Example 12), when the polishing time of the second electrolytic polishing process is less than the polishing time of the first electrolytic polishing process (Example 9, Example 10), a better smoothing effect of the surface of the copper foil can be obtained.

In summary, in the present disclosure, by adding a pickling process between a first electrolytic polishing process and a second electrolytic polishing process, it can remove copper oxide formed on copper foil and/or copper phosphate partially deposited on copper foil during the first electrolytic polishing process. In this way, an average roughness of the surface of the copper foil can be effectively reduced and occurrence of pitting corrosion can be reduced even when the surface of the copper foil has accumulated a high amount of charge due to electrolytic polishing.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A method for smoothing a surface of a copper foil, comprising:

providing the copper foil;

performing a first electrolytic polishing process on the copper foil;

performing a pickling process on the copper foil; and performing a second electrolytic polishing process on the copper foil, wherein the pickling process is performed after the first electrolytic polishing process and before the second electrolytic polishing process, wherein a polishing time of the second electrolytic polishing process is less than a polishing time of the first electrolytic polishing process, and the polishing time of the first electrolytic polishing process is less than or equal to 20 s.

2. The method according to claim 1, wherein the pickling process comprises the following step:

cleaning the copper foil with a pickling solution having a pH value of −1 to 2.

3. The method according to claim 2, wherein the pickling solution comprises phosphoric acid or sulfuric acid, and a content of the phosphoric acid or the sulfuric acid ranges from 2 wt % to 20 wt % based on a total weight of the pickling solution.

4. The method according to claim 1, wherein the first electrolytic polishing process comprises the following step:

placing the copper foil in a polishing solution for electrolytic polishing, wherein the polishing solution comprises at least one nitrogen-containing organic additive, and a content of the at least one nitrogen-containing organic additive ranges from 0.0001 wt % to 1 wt % based on a total weight of the polishing solution.

5. The method according to claim 4, wherein the at least one nitrogen-containing organic additive comprises urea, 2-mercaptobenzoxazole, benzotriazole, 4-carboxybenzotriazole, 5-aminotetrazole, triazol-3-amine or combinations thereof.

6. The method according to claim 1, wherein the first electrolytic polishing process comprises the following conditions: a current density is 5 A/dm2 to 100 A/dm2 and the polishing time is more than or equal to 5 s.

7. The method according to claim 1, wherein the second electrolytic polishing process comprises the following conditions: a current density is 5 A/dm2 to 80 A/dm2 and the polishing time is more than or equal to 5 s.

8. The method according to claim 1, wherein a current density of the second electrolytic polishing process is lower than a current density of the first electrolytic polishing process.

9. The method according to claim 1, further comprising:

performing a passivation treatment process on the copper foil after performing the second electrolytic polishing process.

* * * * *